US006780358B2

(12) United States Patent
Jen

(10) Patent No.: US 6,780,358 B2
(45) Date of Patent: Aug. 24, 2004

(54) MANUFACTURING METHOD FOR POLYESTER YARN EXCELLENT IN YARN TRANSFERRING, PACKAGING AND LOOSING WITH NO WHITE POWDER OCCURRED WHEN WEAVING AND POLYESTER YARN MADE FROM THE SAME

(75) Inventor: Zo-Chun Jen, Taipei Hsien (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 10/653,081

(22) Filed: Sep. 3, 2003

(65) Prior Publication Data

US 2004/0048065 A1 Mar. 11, 2004

(30) Foreign Application Priority Data

Sep. 5, 2002 (TW) ..... 91120361 A

(51) Int. Cl.[7] ..... D01F 6/00; D02G 1/20; D02D 5/12

(52) U.S. Cl. ..... 264/103; 264/169; 264/211.14; 264/210.8; 428/364; 428/395

(58) Field of Search ..... 428/364, 395; 264/103, 169, 211.14, 210.8

(56) References Cited

U.S. PATENT DOCUMENTS 4,041,689 A * 8/1977 Duncan et al. ..... 57/248
6,038,847 A * 3/2000 Jen ..... 57/289
6,620,362 B1 * 9/2003 Jen ..... 264/176.1

* cited by examiner

*Primary Examiner*—N. Edwards
(74) *Attorney, Agent, or Firm*—Bacon & Thomas PLLC

(57) ABSTRACT

Provide a manufacturing method for polyester yarn excellent in yarn transferring, packaging and loosing with no white powder occurred when weaving, which is heating polyester polymer of inherent viscosity (IV) 0.5~0.7 and melting point of 245~265° C. to melt, filter and extruding in constant amount by direct spin drawing of monofilament yarn or combining multi-tow of filaments, then splitting to obtain polyester yarn having high denier in monofilament, characterized in comprising the following steps:

a. uniformly spinning said constant amount extruded polyester melt through spinneret orifices to obtain the filament tows, passing said spun filament tows under spinneret to uniformly cooled to solidify in the quenching air tube, wherein said quenching air tube is equipped with chilling water tubular coil to keep the temperature of quenching air at 10~15° C.;

b. oiling said cooled filament tows, then texturing by the godet roller of direct spin drawing machine, wherein the surface of said godet roller are treated by chrome plating to make the surface roughness of first heating roller in Ra0.025 to 0.1 $\mu$m and the surface roughness of second heating roller in Ra0.1 to 0.5 $\mu$m;

c. drawing said filament tows between said first heating roller and second heating roller with drawing ratio of 3.5~5 times on the basis of the initial length of said filament tows, the temperature of said first heating roller was set at 85~105° C., while the temperature of said second heating roller was set at 130~160° C.;

d. obtaining spin drawing yarn (SDY) of d.p.f. 5 d~55 d by using said conditions, EO/PO (ethylene oxide/propylene oxide) content of spinning finish in oiling is set at 50%~90%.

Polyester yarn of d.p.f. 5 d~55 d excellent in yarn transferring, packaging and loosing with no white powder occurred when weaving manufactured by this invention has higher modulus itself, can avoid streak and speckle in weaving, which is suitable in elastic supporter of shoe material, printing mesh, bridal dress etc.

4 Claims, 2 Drawing Sheets

MANUFACTURING METHOD FOR POLYESTER YARN EXCELLENT IN YARN TRANSFERRING, PACKAGING AND LOOSING WITH NO WHITE POWDER OCCURRED WHEN WEAVING AND POLYESTER YARN MADE FROM THE SAME

TECHNICAL FIELD OF THE INVENTION

The present invention relates to a manufacturing method for polyester yarn having high denier in monofilament, particularly to a manufacturing method for polyester yarn excellent in yarn transferring, packaging and loosing with no white powder occurred when weaving and polyester yarn made from the same.

PRIOR ART AND PROBLEMS TO BE SOLVED BY THE INVENTION

Polyester fiber is mostly used among three major synthetic fiber owing to its good mechanical features, dyeability and low cost. In the recent, demands in cost down, more rigid material such as shoe sewing thread made from polyester yarn is highly desired accompanied with application of high grade shoe materials to instead polyamide yarn. To meet the requirement, polyester yarn having high denier in monofilament is becoming important. Manufacturing process of polyester filament is approximately as follows: polycondensation reaction of terephthalic acid and ethylene glycol to form polyester chip or melt mass, after melting, extrusion, measuring and throughput, then quenching, oil finishing and winding up. While in this process, the quenching effect of the polyester yarn having high denier in monofilament throughput after melt extrusion is very difficult to control, even in the requirement of equipment and the setting of manufacturing condition. This is a long-felt unsolved problem to the person skilled in polyester manufacturing art.

Spin drawing process is familiar to the person skilled in the synthetic yarn manufacture. The polyester yarn having high denier in monofilament is made in the spin drawing process by direct manufacture of monofilament yarn or combining multi-tow of filaments, then splitting to obtain the so-called non-twist splitting yarn.

In Japanese patent publication of unexamined applications Japanese Patent Laid-Open No. 59-116405, a manufacturing method for non-twist splitting yarn is disclosed as follows: multi-filaments are spun and oil finished to monofilament separately. The yarn tows are drawn at the first heating roller, then the second heating roller, and wound up. But in manufacturing the splitting yarn having more than 10 d.p.f. (denier per filament), the splitting yarn transferred onto the first heating roller swung right and left seriously, which is not suitable to mass production.

In addition, a method to decrease the swing occurred onto the first heating roller was disclosed in Japanese patent publication of unexamined applications Japanese Patent Laid-Open No. 3-16154, which comprised a cooling roller established ahead of the first heating roller to increase the pre-tension to the multifilaments, but the oiling tension before the cooling roller still too low. This is not suitable for the improvement and will increase the facility costs.

Similar invention such as Japanese patent publication of unexamined applications Japanese Patent Laid-Open No. 2000-64118, which disclosed a manufacturing method for a synthetic splitting yarn by using one set driven cooling roller established ahead of the first heating roller, then oiling the spun yarn and contacting the pear surface finished godet roller having dynamic friction coefficient of 0.10~0.35 μm. But detailed explanation is not done how surface roughness of a godet roller controls the swing of a splitting yarn.

No matter what the polyester yarn having high denier in monofilament may be manufactured by direct manufacture of monofilament yarn or combining multi-tow of filaments, then splitting to obtain the non-twist splitting yarn. All documents but the above mentioned documents seem to study the swing of yarn to elevate productivity, there is no invention to solve how to improve the bad packaging and white powder occurred in the post stage texturing of polyester yarn having high denier.

Means to solve the Problems

By carefully reviewing the deficiencies occurred in the previous manufacturing technologies of the polyester yarn having high denier in monofilament by using direct spin drawing process such as the insufficient cooling, the swing of the splitting yarn transferred onto the godet roller and bad packaging, white powder occurred when weaving, the inventor discovers that quenching effect can be effectively reached by decreasing the temperature of quenching air tube while not increasing the length of the quenching air tube, decreasing the swing of the splitting yarn transferred onto the godet roller can be reached by decreasing the surface roughness of godet roller to increase the friction between the yarn tow and the godet roller surface. To enhance the endurance of surface roughness of the godet roller, chrome plating treatment onto the godet roller surface is adopted to offer suitable oiling and heating condition, and polyester yarn excellent in yarn transferring, packaging and loosing with no white powder occurred when weaving is obtained so as to complete the present invention.

SUMMARY OF THE INVENTION

It is an object of this invention to provide a manufacturing method for polyester yarn excellent in yarn transferring, packaging and loosing with no white powder occurred when weaving, which is heating polyester polymer of inherent viscosity (IV) 0.5~0.7 and melting point of 245~265° C. to melt, filter and extruding in constant amount by direct spin drawing of monofilament yarn or combining multi-tow of filaments, then splitting to obtain polyester yarn having high denier in monofilament, characterized in comprising the following steps:

a. uniformly spinning said constant amount extruded polyester melt through spinneret orifices to obtain the filament tows, passing said spun filament tows under spinneret to uniformly cooled to solidify in the quenching air tube, wherein said quenching air tube is equipped with chilling water tubular coil to keep the temperature of quenching air at 10~15° C.;

b. oiling said cooled filament tows, then texturing by the godet roller of direct spin drawing machine, wherein the surface of said godet roller are treated by chrome plating to make the surface roughness of first heating roller in Ra0.025 to 0.1 μm and the surface roughness of second heating roller in Ra0.1 to 0.5 μm;

c. drawing said filament tows between said first heating roller and second heating roller with drawing ratio of 3.5~5 times on the basis of the initial length of said filament tows, the temperature of said first heating roller was set at 85~105° C., while the temperature of said second heating roller was set at 130~160° C.;

d. obtaining spin drawing yarn (SDY) of d.p.f. 5 d~55 d by using said conditions, EO/PO (ethylene oxide/ propylene oxide) content of spinning finish in oiling is set at 50%~90%.

In manufacturing synthetic fiber, the higher the d.p.f., the more the length of quenching air tube needed is well-known to the person ordinarily skilled in synthetic fiber manufacture art. In fact, it is not feasible to increase the length of quenching air tube only simply to cool said spun filament tows.

To obtain appropriate quenching for polyester filament tow of d.p.f. 5 d~55 d, the temperature of quenching air tube used in this invention is set at 10~15° C. by installing quenching air source with cooling coil. This will lead the filament tow not too soft to normally produce when oiling onto the oil roller. The requirement of the temperature of quenching air tube used is set at 10~15° C., which is suitable to produce polyester yarn of d.p.f. 5 d~55 d to overcome insufficient cooling due to polyester yarn of higher d.p.f. If the temperature of quenching air tube used is below 10° C., there will be difficult in design itself and may lead higher investment cost; while if the temperature of quenching air tube used is over 15° C., cooling of the filament tow is insufficient and may lead to unstable oiling due to lower tension in filament tow itself, and will frequently cause break in spinning and abnormal dyeability. But if increase the cooling time and lengthen the quenching air tube for the sake of sufficient cooling, this will increase the investment cost.

The cooling media added in the chilling water tubular coil used in the said quenching air source in the manufacturing method of polyester yarn excellent in yarn transferring, packaging and loosing with no white powder occurred when weaving may be chilling water, ethylene glycol (EG) etc.

The section of above mentioned spinneret orifice can be selected from one or more than one of the group of circular, hollow, Y type, —shape type, square shape, triangular shape, hexagonal shape, cross shape and C shape in the manufacturing method of polyester yarn excellent in yarn transferring, packaging and loosing with no white powder occurred when weaving.

The tensile strength of the polyester yarn obtained in this invention is over 4.8 g/d, elongation rate is 20% to 30%, shrinkage rate in boiling water is less than 8%.

The surface of said godet rollers used in this invention are treated by chrome plating to make the surface roughness of first heating roller in Ra0.025 to 0.1 μm and the surface roughness of second heating roller in Ra0.1 to 0.5 μm to get good swing (<1.5 mm) of polyester yarn tow of d.p.f. 5 d~55 d onto said godet roller. Owing to the good swing of polyester yarn tow, non-twist splitting yarn is apt to produce in the manner of low twist and good splitting break.

The surface roughness of said first heating roller used in this invention is in Ra 0.025 to 0.1 μm, which is attained by treating the surface in chrome plating. Chrome plating is better than that of ceramic plating in its better endurance of surface roughness. Life cycle will be elongated to decrease the cost. It is hard to finish the surface roughness less than Ra 0.025 μm, while if the surface roughness of said first heating roller used is over Ra 0.1 μm, not only friction force between the filament tow and godet roller is not enough, but also high temperature softening of the filament tow will cause serious swing to poor spinning productivity. In general, the surface roughness of second heating roller is finished by ceramic plating to get surface roughness of Ra 0.6~0.9 μm. While the surface roughness of second heating roller used in this invention is finished by chrome plating to avoid the quick change in time lapse caused in ceramic plating. Chrome plating of second heating roller is also better than that of ceramic plating in its better endurance of surface roughness. Life cycle will also be elongated to decrease the cost. The requirement of surface roughness is not necessary so fine as that of first heating godet roller, because the filament tows become narrower after drawing, the friction between the filament tows and roller surface increase to cause less swing of the filament tows onto drawing roller and is convenient to change side of winding machine when the spools are in full packaging manner. Consequently, the surface roughness of the second heating roller is specified in the range of Ra 0.1~0.5 μm. If the surface roughness is less than Ra 0.1 μm, though it is favorable to the swing of filament tow, but is not favorable to change-side winding when the spools are in full packaging manner. The reason is the winding tension of polyester yarn of d.p.f. 5 d~55 d must be low and when the surface roughness of drawing roller is less than Ra 0.1 μm, the friction force between filament tow and the second heating roller is too high to re-adhere to the second heating roller due to decrease of tension when change-side winding occurs, this always make filament tow break on winding.

If the surface roughness of said second heating roller used is over Ra 0.5 μm, not only friction force between the filament tow and godet roller is not enough, but also high temperature softening of the filament tow will cause serious swing to poor spinning productivity. The contact area between higher d.p.f. polyester yarn and roller surface is small, the friction force is so small as to cause the swing of filament tow onto roller. The surfaces of said godet rollers in this invention are treated by chrome plating to make the surface roughness of first heating roller in Ra0.025 to 0.1 μm and the surface roughness of second heating roller in Ra0.1 to 0.5 μm, these finishes will effectively increase the contact area between filament tow and roller surface, and reach the object of decreasing the swing of filament tow, which is favorable to the manufacture of polyester yarn of d.p.f. 5 d~55 d.

Consequently, the polyester yarn having high denier in monofilament in this invention can be made in the spin drawing process not only by direct manufacture of monofilament yarn in good productivity, but also can be made by combining multi-tow of filaments, then splitting to obtain the non-twist splitting yarn.

In manufacturing polyester filament yarn of d.p.f. 5 d~55 d, beside the afore-mentioned problems, how to overcome the stiffness and residual stress of polyester yarn is the most important long-felt problem to be solved to the advantage of packaging of filament yarn and stacking of cake and decreasing of filament looseness. Via long-term research, the inventor discovered that the temperature of first heating roller used in common specification yarn of d.p.f. less than 5 d in direct spin drawing yarn process is only higher than its glass transition temperature (Tg) within 10° C., wherein Tg of polyester filament yarn is about 74° C. The lower the temperature of first heating roller set, the better the situation favorable to decrease pilling of filament yarn in wefting and warping. Though there is no problem in stiffness in manufacturing polyester filament yarn of d.p.f. 5 d~55 d, but the bulge of filament cake packaged is big and filament looseness is serious when polyester filament yarn of d.p.f. 5 d~55 d is manufactured under winding machine of same tension (g/d), this lead to undesired productivity.

If only simply to decrease the traversing angle and tension of winding machine to overcome the bulge of filament cake made from polyester yarn of d.p.f. 5 d~55 d and serious film looseness, normal spinning can't be reached due to easy breakage of filament yarn. It is known that this may be caused by stiffness and residual stress of filament yarn of higher d.p.f. by analysis. The inventor put intensive study on roller heating and discovered that only simply to increase the temperature of second heating roller, just decrease the stiffness and residual stress in passive manner. In contrast, this should be improved from the occurrence source in active manner, therefore manufacturing polyester yarn under the first heating roller set at the temperature higher than Tg of polyester yarn is the most effective method. In usual, polyester yarn of d.p.f. 5 d~55 d is always subjected to elongate in higher drawing ratio of 3.5~5 times to the polyester yarn, if heating of first heating roller is not sufficient and high speed production by direct spinning draw yarn process is taken, this may lead to higher residual stress and stiffness in polyester yarn of d.p.f. 5 d~55 d, which is just like cold draw to molecule in the internal portion of monofilament, this will not fit for filament yarn packaging. The winding tension of winder can be decreased to 0.1 g/d by using this invention to get good productivity, good cake package, good dyeability due to sufficient heating to filament yarn. It must be emphasized that elevating the temperature of first heating roller will moderately increase filament yarn to swing now to the left and now to the right Temperature of said quenching air and surface roughness must be matched to effectively overcome the swing of filament tow and elevate the productivity.

By using direct spinning yarn process in this invention, residual stress of polyester filament yarn of d.p.f. 5 d~55 d can be effectively decreased when the polyester filament yarn is subjected to 3.5~5 times elongation by setting temperature of first heating roller at 85~105° C., temperature of second heating roller at 130~160° C., to decrease winding temperature and stabilize the productivity to get cake of good package. If the temperature of first heating roller is below 85° C., it is found that winding tension of filament yarn can be decreased when filament yarn is in draw texturing, and bulge will be found in cake packaging and filament looseness will be found. The reason is no sufficient softening occurs due to the higher denier of polyester filament yarn of d.p.f. 5 d~55 d to cause higher residual stress. If the temperature of first heating roller is higher than 105° C., the filament yarn is too soft, the filament yarn swing now to the left and now to the right greatly and re-adhere to roller, which is not suitable to normal spinning. If the temperature of second heating roller is lower than 130° C., residual stress of filament yarn can't be effectively decreased, and the winding tension can't be decreased so as to cause bulge in the cake and looseness. The productivity will be worst if the winding tension is decreased reluctantly. If the temperature of second heating roller is higher than 160° C., the filament yarn swing now to the left and now to the right greatly and the productivity become worst.

In manufacturing polyester filament yarn of d.p.f. 5 d~55 d, beside the afore-mentioned problems, the most important long-felt problem to be solved is the white powder which is apt to be found when the filament yarn is to be woven, streak will be seen on the clothing surface, or the filament yarn is easily broken during splitting texture accompanied with wefting and warping. The reason of white powder occurred was searched The reason why white powder occurred is that filament molecule will be highly oriented to form high crystallization when the filament yarn is subjected to high elongation, white powder will be deposited onto the yarn guide of yarn path due to friction occurred between yarn guide and filament yarn, the white powder will be brought into clothing surface to cause streak and speckle in weaving. Though the molecular orientation and crystallization can be slightly improved by decreasing drawing ratio, but in actual application decreasing the drawing ratio or decreasing the molecular orientation and crystallization of filament is equal to elevating the elongation of filament and unstability of filament. This will easily cause negative effect such as abnormal drawing occurred in the post stage weaving finish, and lose the stiffness characteristic of filament yarn of higher d.p.f.

For not decreasing stiffness characteristics and preventing the white powder occurred, improvement on the enhancement of oil film strength of spinning finish used in this invention is made. In general, spinning finish used in polyester filament spinning is composed of ingredients such as various additives, and the EO/PO (ethylene oxide/propylene oxide) content of spinning finish can be different if required. Upon experiments, EO/PO (ethylene oxide/propylene oxide) content of spinning finish used in this invention is preferably set at the range between 50 to 90%, the white powder occurred can be greatly decreased. If EO/PO (ethylene oxide/propylene oxide) content of spinning finish is less than 50%, the oil film strength is too low to increase white powder when wefting and warping of filament yarn. If EO/PO (ethylene oxide/propylene oxide) content of spinning finish is greater than 90%, it is difficult to meter the other auxiliary additives and is not suitable for operation.

Polyester yarn of d.p.f. 5 d~55 d excellent in yarn transferring, packaging and loosing with no white powder occurred when weaving manufactured by this invention has higher modulus itself, can avoid streak and speckle in weaving, which is suitable in elastic supporter of shoe material, printing mesh, bridal dress etc.,.

Analytical Procedures (1) Surface roughness:

Analytical apparatus:

HOMMELWERKE T1000C roughness apparatus

Analysis condition:

By sampling specimen godet roller in 15 mm length, measuring the surface roughness with the above mentioned apparatus.

(2) White powder remaining amount

Analytical apparatus:

ZINSER DT 517 Draw Twister

Analytical conditions:

For filament yarns oiled with spinning finish of different EO/PO content, evaluate and compare the white powder remained on the limiting ring through which the filament yarn being re-wound in speed 890 m/min and transferring in the same time interval.

(3) d.p.f.(denier per filament):

Winding filament tow 90 loops, weighing (weight shown in a gram), multiply a with 100 to get total denier b of filament tow. The b is divided by c, the number of filament in filament tow to get d.p.f. (denier per filament).

(4) Tensile strength:

Analytical apparatus:

TEXTECHNO STATIMAT M Analyzer

Analytical condition:

Analyzing with initial length 500 mm, speed 600 m/min, initial load 0.5 cN/tex.

(5) Shrinkage ratio in boiling water:

Analytical condition:

Sampling 20 loops of polyester yarn, hanging with weight 100 g at the lower side, weighing the length as initial length L, then putting said yarn loop hanged with 100 g weight in the boiling water for 30 minutes, taking 100 g weight away, then measuring the length of yarn loop after shrinkage as $L_1$, the shrinkage ratio in boiling water (%) is shown as $100\times(L-L_1)$.

Figure 1:
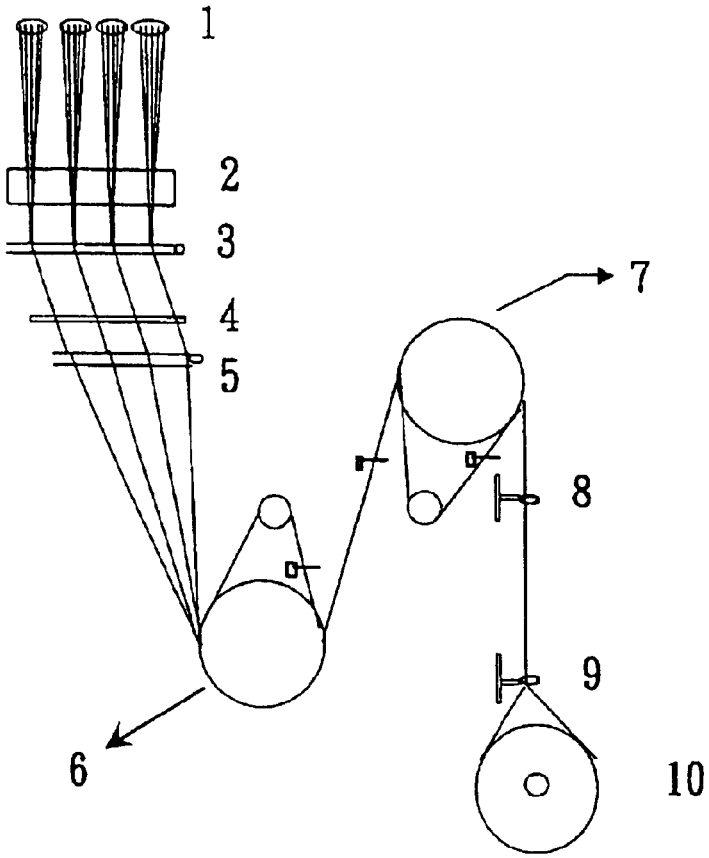
FIG. 1 shows a schematic diagram of a yarn path for direct spin drawing yarn used in this invention.

Numerals used in the drawings are meant as follows.

1. spinneret

2. oiling roller

3. fish eye shape yarn guide

4. rod shape yarn guide

5. wheel shape yarn guide

6. first heating roller

7. second heating roller

8. dog tail shape yarn guide

9. dog tail shape yarn guide

10. filament cake

EXAMPLES AND COMPARATIVE EXAMPLES

Example 1~5 and Comparative Example 1~4

Basic conditions of filament yarn are the same in each example as follows. Melting the polyester chip at 285° C. through spinneret of orifice in diameter 0.6 mm, cooling the polyester melt into filament yarn with quenching air of various temperatures, then oiling the filament yarn with spinning finishes of different EO/PO content in oiling amount of 0.8%, drawing the filament yarn in speed 900 m/min through first heating roller, then drawing the filament yarn with 400% drawing ratio, through the second heating roller, winding the filament yarn up to get filament cake. Comparative examples are used comparison and explanation.

As to example 1, the filament yarn obtained is 100 d/10 f in specification, temperature of quenching air used is 15° C., filament yarn is under excellent condition(solidification of filament yarn is good), oiling of yarn is stable (swing width<3 mm, contact between filament yarn and oiling roller is good to make excellent linearity.). Temperature of first heating roller is set at 85° C., surface roughness of first heating roller is Ra 0.1 μm, the swing width of filament yarn onto first heating roller is excellent (swing width<1.5 mm); while temperature of second heating roller is set at 130° C., surface roughness of second heating roller is Ra 0.5 μm, the swing width of filament yarn onto second heating roller is excellent (swing width<1.5 mm). Tension of filament yarn in the winding machine is 0.1 g/d, productivity is excellent (breakage of filament yarn is under 5 times per daily line.). EO/PO content in the spinning finish is 50%. No white powder occurred when weaving the filament yarn obtained in example 1. Splitting characteristics of filament yarn is excellent (filament yarn break under 0.03 times per kilogram filament cake.), yarn transferring, packaging and loosing Is excellent (filament yarn break under 0.3 yarns per kilogram filament cake.).

As to example 2, the filament yarn obtained is 200 d/10 f in specification, temperature of quenching air used is 14° C., filament yarn is under excellent condition, oiling of yarn is stable (swing width<3 mm, contact between filament yarn and oiling roller is good to make excellent linearity.). Temperature of first heating roller is set at 93° C., surface roughness of first heating roller is Ra 0.1 μm, the swing width of filament yarn onto first heating roller is excellent (swing width<1.5 mm); while temperature of second heating roller is set at 135° C., surface roughness of second heating roller is Ra 0.5 μm, the swing width of filament yarn onto second heating roller is excellent (swing width<1.5 mm). Tension of filament yarn in the winding machine is 0.1 g/d, productivity is excellent (breakage of filament yarn is under 5 times per daily line.). EO/PO content in the spinning finish is 73%. No white powder occurred when weaving the filament yarn obtained in example 2. Splitting characteristics of filament yarn is excellent (filament yarn break under 0.03 times per kilogram filament cake.), yarn transferring, packaging and loosing is excellent (filament yarn break under 0.3 yarns per kilogram filament cake.).

Figure 2:
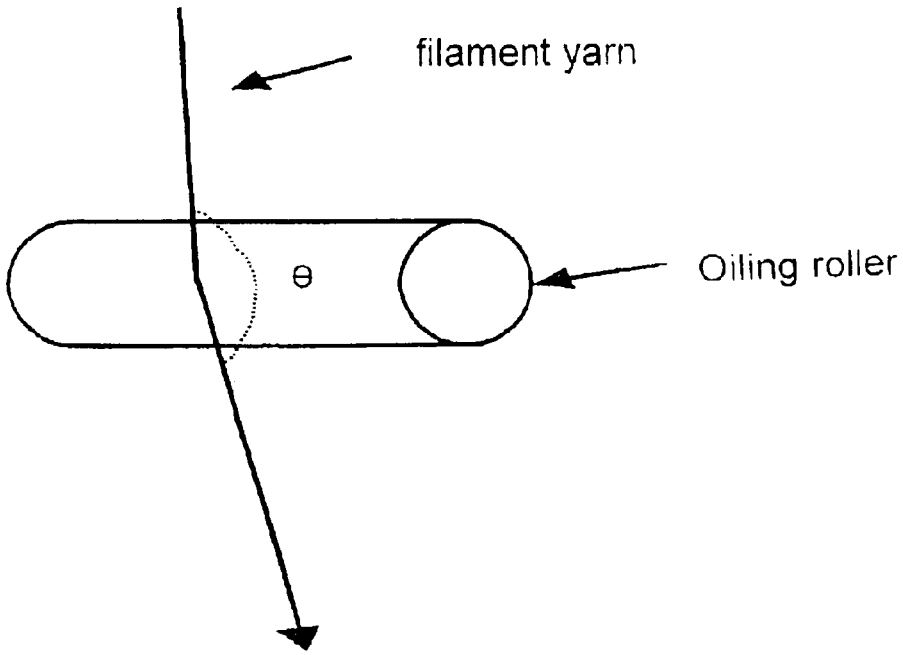
FIG. 2 shows a schematic diagram of contact between filament yarn and oiling roller used in this invention.

As to example 3, the filament yarn obtained is 50 d/1 f in specification, temperature of quenching air used is 10° C., filament yarn is under good condition, oiling of yarn is stable (swing width is between 3 mm to 5 mm, after the contact between filament yarn and oiling roller, bending angle θ of filament to the roller is about 165 ■, oiling in nonlinear way as shown in FIG. 2. Temperature of first heating roller is set at 105° C., surface roughness of first heating roller is Ra 0.025 μm, the swing width of filament yarn onto first heating roller is good (swing width is in the range of 1.5 mm~2 mm); while temperature of second heating roller is set at 160° C., surface roughness of second heating roller is Ra 0.1 μm, the swing width of filament yarn onto second heating roller is good (swing width is in the range of 1.5 mm~2 mm). Tension of filament yarn in the winding machine is 0.1 g/d, productivity is good (breakage of filament yarn is between 5 times to 8 times per daily line.). EO/PO content in the spinning finish is 90%. No white powder occurred when weaving the filament yarn obtained in example 3. Yarn transferring, packaging and loosing is excellent (filament yarn break in a range of 0.3~0.6 yarns per kilogram filament cake.). As to comparative example 2, the filament yarn obtained is 50 d/1 f in specification, temperature of quenching air used is 22° C., filament yarn is under bad condition, oiling of yarn is bad (swing width is between 5 mm to 8 mm, after the contact between filament yarn and oiling roller, bending angle θ of filament to the roller is about 150 ■, oiling in nonlinear way. Temperature of first heating roller is set at 82° C., surface roughness of first heating roller is Ra 0.025 μm, the swing width of filament yarn onto first heating roller is good (swing width<1.5 mm); while temperature of second heating roller is set at 160° C., surface roughness of second heating roller is Ra 0.1 μm, the swing width of filament yarn onto second heating roller is good (swing width is in the range of 1.5 mm~2 mm). Tension of filament yarn in the winding machine is 0.15 g/d, productivity is bad (breakage of filament yarn is between 8 times to 12 times per daily line.). EO/PO content in the spinning finish is 90%. No white powder occurred when weaving the filament yarn obtained in comparative example 2. Yarn transferring, packaging and loosing is serious (filament yarn break>2 yarns per kilogram filament cake.).

As to comparative example 4, the filament yarn obtained is 50 d/1 f in specification, temperature of quenching air used is 10° C., filament yarn is under good condition, oiling of yarn is good (swing width is between 3 mm to 5 mm, after the contact between filament yarn and oiling roller, bending angle θ of filament to the roller is about 165 ■, oiling in nonlinear way. Temperature of first heating roller is set at 96° C., surface roughness of first heating roller is Ra 0.2 μm, the swing width of filament yarn onto first heating roller is bad (swing width>3 mm); while temperature of second heating roller is set at 160° C., surface roughness of second heating roller is Ra 0.9 μm, the swing width of filament yarn onto second heating roller is very bad (swing width>3 mm). Tension of filament yarn in the winding machine is 0.15 g/d, productivity is very bad (breakage of filament yarn>12 times per daily line.). EO/PO content in the spinning finish is 15%. White powder occurred when weaving the filament yarn obtained in comparative example 4. Yarn transferring, packaging and loosing is good (filament yarn break<0.3 yarns per kilogram filament cake.).

As to example 4, the filament yarn obtained is 30 d/1 f in specification, temperature of quenching air used is 13° C., filament yarn is under excellent condition(solidification of filament yarn is good), oiling of yarn is stable (swing width<3 mm, contact between filament yarn and oiling roller is good to make excellent linearity.). Temperature of first heating roller is set at 96° C., surface roughness of first heating roller is Ra 0.025 μm, the swing width of filament yarn onto first heating roller is excellent (swing width<1.5 mm); while temperature of second heating roller is set at 140° C., surface roughness of second heating roller is Ra 0.3 μm, the swing width of filament yarn onto second heating roller is excellent (swing width<1.5 mm). Tension of filament yarn in the winding machine is 0.1 g/d, productivity is excellent (breakage of filament yarn is under 5 times per daily line.). EO/PO content in the spinning finish is 80%. No white powder occurred when weaving the filament yarn obtained in example 4. Yarn transferring, packaging and loosing is excellent (filament yarn break under 0.3 yarns per kilogram filament cake.).

As to example 5, the filament yarn obtained is 300 d/10 f in specification, temperature of quenching air used is 12° C., filament yarn is under excellent condition(solidification of filament yarn is good), oiling of yarn is stable (swing width<1.5 mm). Temperature of first heating roller is set at 96° C., surface roughness of first heating roller is Ra 0.025 μm, the swing width of filament yarn onto first heating roller is excellent (swing width<1.5 mm); while temperature of second heating roller is set at 140° C., surface roughness of second heating roller is Ra 0.3 μm, the swing width of filament yarn onto second heating roller is excellent (swing width<1.5 mm). Tension of filament yarn in the winding machine is 0.1 g/d, productivity is good (breakage of filament yarn is under 5 times per daily line.). EO/PO content in the spinning finish is 83%. No white powder occurred when weaving the filament yarn obtained in example 1. Splitting characteristics of filament yarn is excellent (filament yarn break under 0.03 times per kilogram filament cake.), yarn transferring, packaging and loosing Is excellent (filament yarn break under 0.3 yarns per kilogram filament cake.).

As to comparative example 1, the filament yarn obtained is 300 d/10 f in specification, temperature of quenching air used is 12° C., filament yarn is under excellent condition (solidification of filament yarn is good), oiling of yarn is stable (swing width<3 mm, contact between filament yarn and oiling roller is good to make excellent linearity.). Temperature of first heating roller is set at 96° C., surface roughness of first heating roller is Ra 0.2 μm, the swing width of filament yarn onto first heating roller is bad (swing width is in the range of 2 mm~3 mm); while temperature of second heating roller is set at 140° C., surface roughness of second heating roller is Ra 0.7 μm, the swing width of filament yarn onto second heating roller is bad (swing width is in the range of 2 mm~3 mm). Tension of filament yarn in the winding machine is 0.1 g/d, productivity is very bad (breakage of filament yarn is over 12 times per daily line.). EO/PO content in the spinning finish is 83%. No white powder occurred when weaving the filament yarn obtained in comparative example 1. Splitting characteristics of filament yarn is very bad (filament yarn break is over 1.5 times per kilogram filament cake.), yarn transferring, packaging and loosing is excellent (filament yarn break under 0.3 yarns per kilogram filament cake.).

The results of example 1~5 and comparative 1~4 are shown in table 1.

TABLE 1

| | Example | | | | | Comparative Example | | | |
|---|---|---|---|---|---|---|---|---|---|
| No. | 1 | 2 | 3 | 4 | 5 | 1 | 2 | 3 | 4 |
| Specification | 100d/10f | 200d/10f | 50d/1f | 30d/1f | 300d/10f | 300d/10f | 50d/1f | 30d/1f | 50d/1f |
| Temperature of quenching air | 15 | 14 | 10 | 13 | 12 | 12 | 22 | 22 | 10 |
| oiling of filament yarn (solidification of filament yarn) | ◎ | ◎ | ○ | ◎ | ◎ | ◎ | X | X | ○ |
| Temperature of first heating roller | 85° C. | 93° C. | 105° C. | 96° C. | 96° C. | 96° C. | 82° C. | 80° C. | 96° C. |
| Surface roughness Ra | 0.1 μm | 0.1 μm | 0.025 μm | 0.025 μm | 0.025 μm | 0.2 μm | 0.025 μm | 0.025 μm | 0.2 μm |
| Swing | ◎ | ◎ | ○ | ◎ | ◎ | X | ◎ | ◎ | X X |
| Temperature of second heating roller | 130° C. | 135° C. | 160° C. | 140° C. | 140° C. | 140° C. | 160° C. | 140° C. | 160° C. |
| Surface roughness Ra | 0.5 μm | 0.5 μm | 0.1μm | 0.3 μm | 0.3 μm | 0.7 μm | 0.1 μm | 0.5 μm | 0.9 μm |
| Swing | ◎ | ◎ | ○ | ◎ | ◎ | X | ○ | ○ | X X |
| Winding tension | 0.1 g/d | 0.1 g/d | 0.1 g/d | 0.1 g/d | 0.1 g/d | 0.1 g/d | 0.15 g/d | 0.13 g/d | 0.1 g/d |

TABLE 1-continued

| | Example | | | | | Comparative Example | | | |
|---|---|---|---|---|---|---|---|---|---|
| No. | 1 | 2 | 3 | 4 | 5 | 1 | 2 | 3 | 4 |
| Productivity | ⊙ | ⊙ | ○ | ⊙ | ⊙ | X X | X | X | X X |
| EO/PO content of spinning finish | 50% | 73% | 90% | 80% | 83% | 83% | 90% | 10% | 15% |
| White powder | ⊙ | ⊙ | ⊙ | ⊙ | ⊙ | ⊙ | ⊙ | X X | X |
| Splitting | ⊙ | ⊙ | / | / | ⊙ | X X | / | / | / |
| Packaging and loosing | ⊙ | ⊙ | ○ | ⊙ | ⊙ | ⊙ | X X | X | ⊙ |

⊙: Excellent;
○: good;
X: bad;
X X: very bad

What is claimed is:

1. A manufacturing method for polyester yarn excellent in yarn transferring and filament packaging with no white powder occurred when weaving, which is heating polyester polymer of inherent viscosity (IV) 0.5~0.7 and melting point of 245~265° C. to melt, filter and extruding in constant amount by direct spin drawing of monofilament yarn or combining multi-tow of filaments, then splitting to obtain polyester yarn having high denier in monofilament, characterized in comprising the following steps:

a. uniformly spinning said constant amount extruded polyester melt through spinneret orifices to obtain the filament tows, passing said spun filament tows under spinneret to uniformly cooled to solidify in the quenching air tube, wherein said quenching air tube is equipped with chilling water tubular coil to keep the temperature of quenching air at 10~15° C.;

b. oiling said cooled filament tows, then texturing by the godet roller of direct spin drawing machine, wherein the surface of said godet roller are treated by chrome plating to make the surface roughness of first heating roller in Ra0.025 to 0.1 $\mu$m and the surface roughness of second heating roller in Ra0.1 to 0.5 $\mu$m;

c. drawing said filament tows between said first heating roller and second heating roller with drawing ratio of 3.5~5 times on the basis of the initial length of said filament tows, the temperature of said first heating roller was set at 85~105° C., while the temperature of said second heating roller was set at 130~160° C.;

d. obtaining spin drawing yarn (SDY) of d.p.f. 5 d~55 d by using said conditions, EO/PO (ethylene oxide/propylene oxide) content of spinning finish in oiling is set at 50%~90%.

2. The manufacturing method for polyester yarn excellent in yarn transferring and filament packaging with no white powder occurred when weaving according to claim 1, whererin the section of said spinneret orifices is selected from one or more than one of the group of circular, hollow, Y type, —shape type, square shape, triangular shape, hexagonal shape, cross shape and C shape.

3. The manufacturing method for polyester yarn excellent in yarn transferring and filament packaging with no white powder occurred when weaving according to claim 1, whererin the cooling media added in the said chilling water tubular coil is selected from one or more than one of chilling water, ethylene glycol (EG).

4. Polyester yarn excellent in yarn transferring, packaging and loosing with no white powder occurred when weaving, which is manufactured by the manufacturing method for polyester yarn excellent in yarn transferring and filament packaging with no white powder occurred when weaving according to claim 1, wherein the tensile strength of the polyester yarn obtained is over 4.8 g/d, elongation rate is 20% to 30%, shrinkage rate in boiling water is less than 8%.

* * * * *